US009808901B2

(12) United States Patent
Dovel

(10) Patent No.: US 9,808,901 B2
(45) Date of Patent: Nov. 7, 2017

(54) SELECTIVELY DEPLOYABLE ROTATABLE EDGE GUIDE TO SUPPORT A CUTTING TOOL DURING A SHARPENING OPERATION

(71) Applicant: Darex LLC, Ashland, OR (US)

(72) Inventor: Daniel T. Dovel, Shady Cove, OR (US)

(73) Assignee: Darex, LLC, Ashland, OR (US)

( * ) Notice: Subject to any disclaimer, the term of this patent is extended or adjusted under 35 U.S.C. 154(b) by 598 days.

(21) Appl. No.: 14/290,587

(22) Filed: May 29, 2014

(65) Prior Publication Data

US 2015/0343590 A1 Dec. 3, 2015

(51) Int. Cl.

| | |
|---|---|
| ***B24B 3/36*** | (2006.01) |
| ***B24B 23/02*** | (2006.01) |
| ***B24B 23/06*** | (2006.01) |
| ***B24B 23/00*** | (2006.01) |

(52) U.S. Cl.

CPC ..... *B24B 3/36* (2013.01); *B24B 23/005* (2013.01); *B24B 23/02* (2013.01); *B24B 23/06* (2013.01)

(58) Field of Classification Search

CPC .. B24B 3/54; B24B 3/36; B24B 21/20; B24D 15/08; B24D 15/06

USPC ..... 451/45, 311, 349, 371, 267, 282, 241, 451/208, 224; 76/82, 86, 88–89

See application file for complete search history.

(56) References Cited

U.S. PATENT DOCUMENTS

| | | | | |
|---|---|---|---|---|
| 2,142,105 A * | 1/1939 | Blankner | ..... | B24B 3/54 451/164 |
| 4,934,108 A * | 6/1990 | Hall | ..... | B24B 3/38 451/358 |
| 8,784,162 B1 * | 7/2014 | Dovel | ..... | B24B 3/54 451/303 |
| 2007/0281594 A1 * | 12/2007 | Jones | ..... | B24B 3/36 451/367 |

* cited by examiner

*Primary Examiner* — Larry E Waggle, Jr.
*Assistant Examiner* — Lauren Beronja
(74) *Attorney, Agent, or Firm* — Hall Estill Attorneys at Law

(57) ABSTRACT

Apparatus for sharpening a cutting tool. In some embodiments, a tool sharpener includes an abrasive medium having an abrasive surface. A stationary tool support guide provides a guide surface that supports a side of the tool during presentation of a cutting edge of the tool against the abrasive surface. A rotatable edge guide has a roller member with a curvilinearly extending outer surface. The roller member is rotatable about an edge guide roller axis and is moveable between a deployed position and a retracted position. In the deployed position, the roller member is positioned to engage, via rolling contact, the cutting edge during the presentation of the cutting edge against the abrasive surface. In the retracted position, the roller member is positioned to provide a non-contacting clearing relation with the cutting edge during said presentation.

24 Claims, 10 Drawing Sheets

SELECTIVELY DEPLOYABLE ROTATABLE EDGE GUIDE TO SUPPORT A CUTTING TOOL DURING A SHARPENING OPERATION

BACKGROUND

Cutting tools are used in a variety of applications to cut or otherwise remove material from a workpiece. A variety of cutting tools are well known in the art, including but not limited to knives, scissors, shears, blades, chisels, spades, machetes, saws, drill bits, etc.

A cutting tool often has one or more laterally extending, straight or curvilinear cutting edges along which pressure is applied to make a cut. The cutting edge is often defined along the intersection of opposing surfaces that intersect along a line that lies along the cutting edge.

Cutting tools can become dull over time after extended use. It can thus be desirable to subject a dulled cutting tool to a sharpening operation to restore the cutting edge to a greater level of sharpness. A variety of sharpening techniques are known in the art, including the use of grinding wheels, whet stones, abrasive cloths, etc. While these and other sharpening techniques have been found operable, there is a continued need for improvements in the manner in which various cutting tools may be sharpened.

SUMMARY

Various embodiments of the present disclosure are generally directed to an apparatus for sharpening a cutting edge of a tool.

In some embodiments, a tool sharpener is provided with an abrasive medium having an abrasive surface. A stationary tool support guide has a guide surface that extends along a guide plane at a selected angle with respect to the abrasive surface. The guide surface contactingly supports a side of the tool during presentation of a cutting edge of the tool against the abrasive surface. A rotatable edge guide adjacent the stationary tool support guide has a roller member with a curvilinearly extending outer surface. The roller member is rotatable about an edge guide roller axis and is moveable between a deployed position and a retracted position. In the deployed position, the roller member is positioned to contactingly engage the cutting edge during the presentation of the cutting edge against the abrasive surface. In the retracted position, the roller member is positioned to provide a non-contacting clearing relation with the cutting edge during said presentation.

In related embodiments, the tool sharpener has a base structure which encloses an electric motor. An abrasive medium is supported by the base structure and adapted for rotational movement responsive to the electric motor, the abrasive medium having an abrasive surface extending along a neutral plane. A stationary tool support guide has a guide surface extending along a guide plane at a selected angle with respect to the neutral plane to engage, via sliding contact, a side of the tool during presentation of a cutting edge of the tool against the abrasive surface. A rotatable edge guide adjacent the stationary tool support guide has a roller member having a curvilinearly extending outer surface rotatable about an edge guide roller axis. The rotatable edge guide is rotatable about an edge guide central axis between a deployed position and a retracted position. In the deployed position, the roller member is a first distance from the guide surface to facilitate rolling support of the cutting edge during said presentation. In the retracted position, the roller member is a second distance from the guide surface greater than the first distance to provide a non-contacting, clearing relation with the cutting edge during said presentation.

In further related embodiments, the tool sharpener has an endless abrasive belt with an abrasive surface. The belt is over a belt roller and placed under tension to present a planar extent of the belt adjacent the roller, the roller rotatable about a first axis. A stationary tool support guide has a guide surface extending along a guide plane at a selected angle with respect to the planar extent of the belt to engage, via sliding contact, a side of the tool during presentation of a cutting edge of the tool against the abrasive surface of the belt. A rotatable edge guide adjacent the stationary tool support guide includes a roller member having a curvilinearly extending outer surface rotatable about a second axis orthogonal to the first axis to engage, via rolling contact, the cutting edge during said presentation of the cutting edge against the abrasive surface.

These and other aspects of various embodiments of the present disclosure will become apparent from a review of the following detailed description in conjunction with the accompanying drawings.

DETAILED DESCRIPTION

Figure 1:
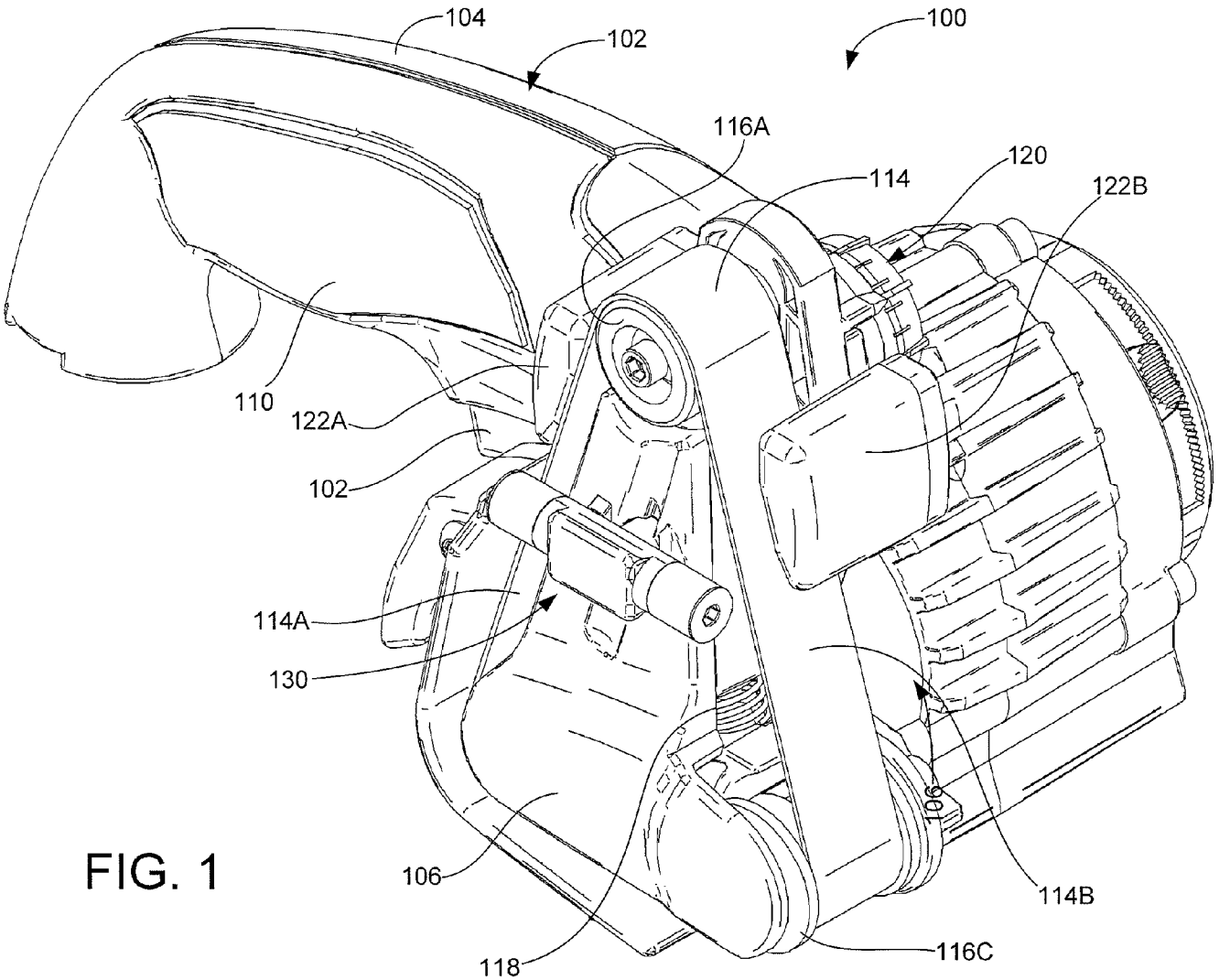
FIG. 1 is an isometric depiction of a tool sharpener constructed in accordance with some embodiments of the present disclosure.
Figure 2A:
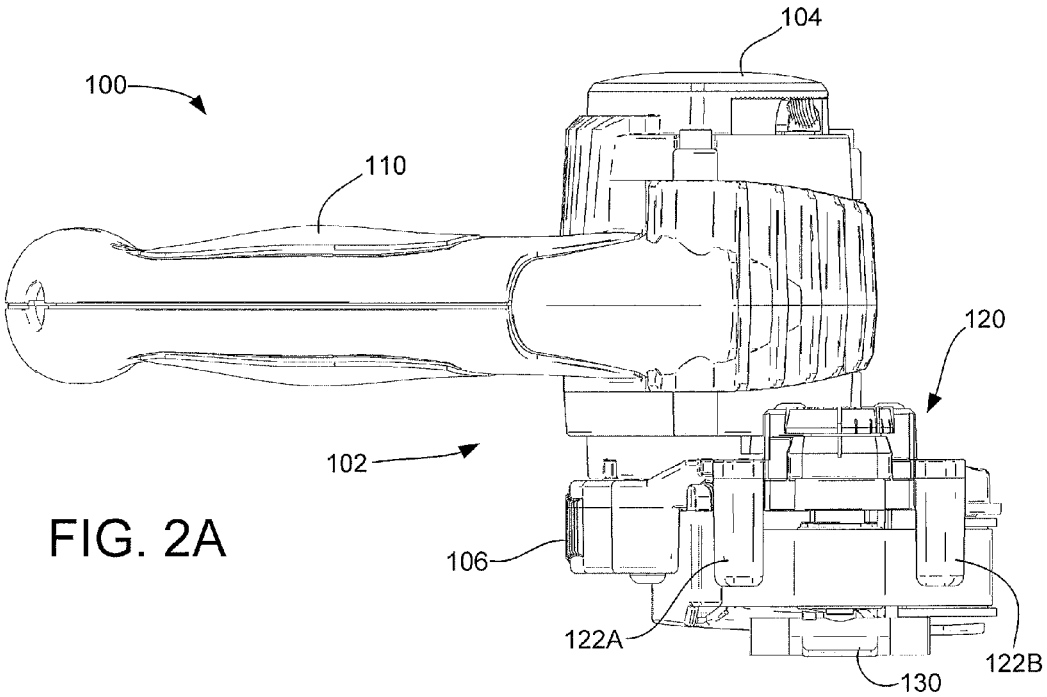
FIG. 2A is a top plan view of the tool sharpener of FIG. 1.
Figure 2B:
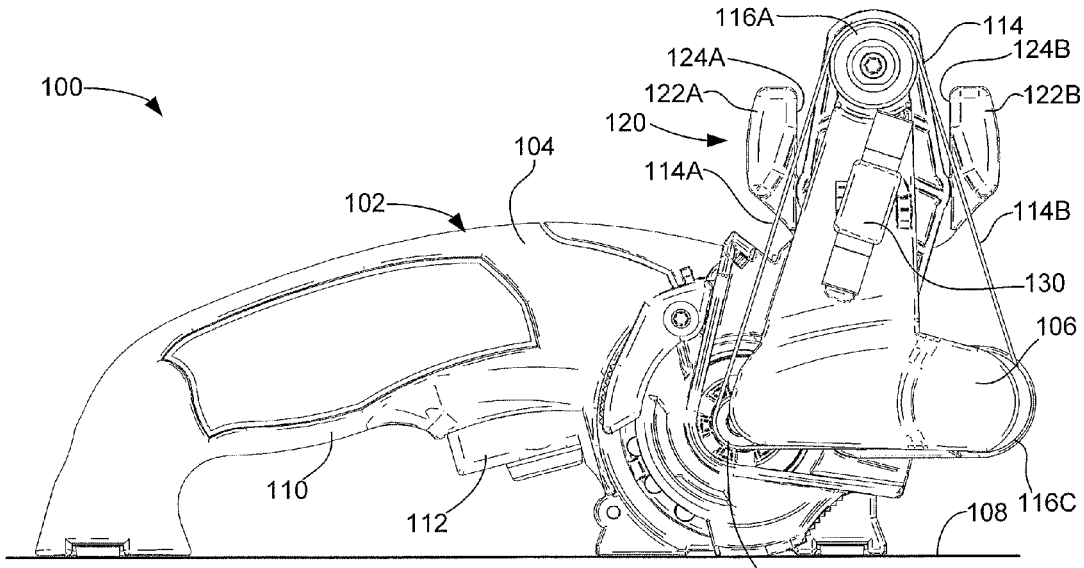
FIG. 2B is a front side elevational view of the tool sharpener of FIG. 1.

FIG. 1 shows an exemplary tool sharpener 100 constructed in accordance with some embodiments of the present disclosure. The tool sharpener 100 is configured to sharpen a variety of tools with different configurations of cutting edges. Top and front side views of the tool sharpener 100 are provided in FIGS. 2A and 2B. The tool sharpener 100 is characterized as a hand-held powered sharpener.

The tool sharpener 100 includes a base structure 102 which encloses and/or supports various components of interest. The structure 102 includes a main body 104 and a sharpening attachment assembly 106. The sharpening attachment assembly 106 can be removably mated with the main body 104 to facilitate various sharpening operations described below. As desired, other operable attachments (not separately shown) can be installed on the main body 104 to carry out other motor-driven functions.

The main body 104 is adapted to be securely placed on a base surface 108 (FIG. 2B) or, alternatively, to be picked up and supported by a user of the tool sharpener 100. A handle 110 has a user grip surface adapted to be grasped by a hand of the user. A trigger assembly 112 can be selectively depressed to energize a motor (not separately shown) disposed within the main body 104. An electrical power cord (also not separately shown) can extend from an end of the main body 104 to supply electrical power for use by the sharpener 100.

The motor is used to drive an abrasive member 114 during a sharpening operation. The abrasive member 114 is characterized as an endless abrasive belt which is routed along a belt path that passes adjacent rollers 116A, 116B and 116C. Other forms of abrasive members can be used in accordance with the present disclosure, including disc shaped abrasive members, non-motor driven abrasive members, etc. It will be noted that the abrasive belt 114 is supported by, and is located outside of, the base structure 102 to expose various portions of the belt for sharpening operations and to facilitate easy removal and replacement of the belt.

A spring-biased tensioner assembly 118 coupled to roller 116C applies a tension force to the abrasive member (hereinafter, "belt") 114. This forms two planar extents 114A, 114B that extend between rollers 116A-116B and 116A-116C, respectively. The planar extents 114A, 114B are best viewed in FIG. 2B. The planar extents are nominally maintained along respective neutral planes except when deflected during a sharpening operation through contact with the cutting edge of a tool, as discussed below.

An adjustable sharpening guide assembly 120 is provisioned adjacent the planar extents 114A, 114B. The sharpening guide assembly 120 includes a pair of opposing, stationary sharpening guides 122A, 122B. The stationary sharpening guides 122A, 122B have respective guide surfaces 124A, 124B which extend along respective guide planes at a common, fixed acute angle with respect to the neutral planes of the planar extents 114A, 114B.

The guide surfaces 124A, 124B contactingly support the respective side surfaces of a cutting tool during a double-sided sharpening operation as the cutting tool is presented against each guide surface in turn. A cam-based adjustment mechanism can be used to selectively set the guide surfaces 124A, 124B to the common, fixed acute angle. Angles from about 15 degrees to about 30 degrees can be selected.

Figure 3A:
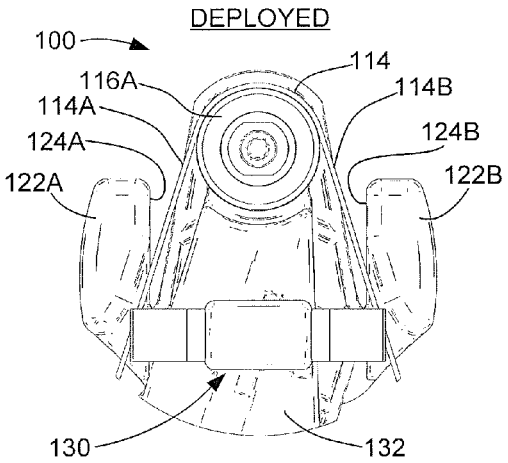
FIGS. 3A and 3B show a rotatable edge guide of the tool sharpener in a deployed position and in a retracted position, respectively.
Figure 3B:
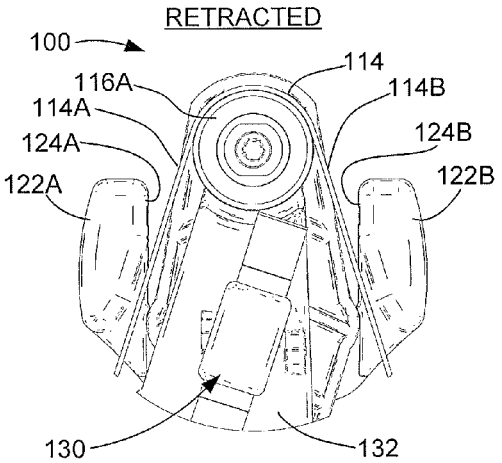

A rotatable edge guide is represented generally at 130. As further shown in FIGS. 3A and 3B, the rotatable edge guide 130 is rotatable with respect to the base structure 102 (in this case, a base support plate 132 of attachment 106) between a deployed position (FIG. 3A) and a retracted position (FIG. 3B). It will be noted that the rotatable edge guide 130 is shown in the deployed position in FIGS. 1 and 2A, and shown in the retracted position in FIG. 2B.

Figure 4:
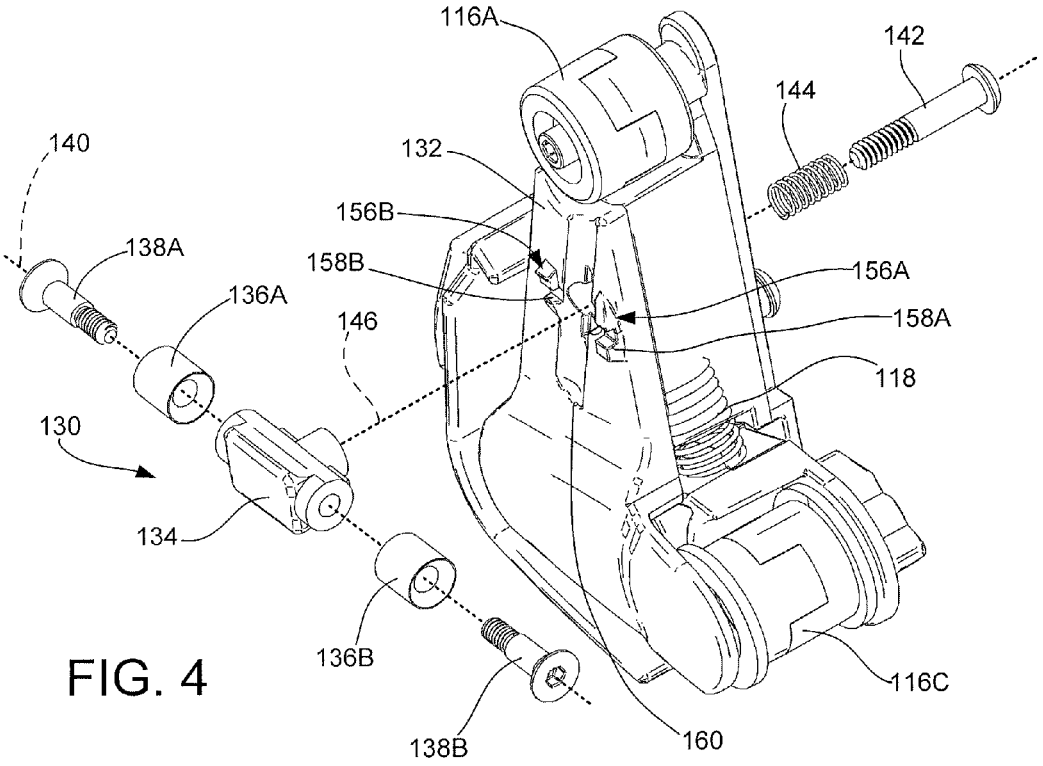
FIG. 4 is an exploded isometric view of the rotatable edge guide of FIGS. 3A-3B.

FIG. 4 provides an exploded representation of the rotatable edge guide 130 in accordance with some embodiments. The rotatable edge guide 130 includes a central body 134 which supports opposing roller members 136A, 136B. The roller members 136A, 136B are each provided with a curvilinearly extending outer surface. The surfaces are cylindrically shaped in FIG. 4, but other shapes can be used including v-shaped members, etc.

It is contemplated that the roller members 136A, 136B are formed of a suitable compliant material, such as a non-marring plastic. The use of a compliant material will tend provide a desired level of friction between the roller member and the cutting edge to ensure rotational movement of the roller is established during retraction of the tool. However, other materials can be used including rigid materials such as metal for the roller members.

Shaft fasteners 138A, 138B secure the roller members 136A, 136B to the central body 134 and facilitate independent rotation of the roller members about an edge roller guide axis 140.

The central body 134 is secured to the plate 132 using shaft fastener 142. A biasing member (e.g., coiled spring) 144 exerts a biasing force upon the central body 134 to urge the central body in a direction toward the plate 132. The shaft fastener 142 and biasing member 144 facilitate selective rotation of the central body 134 about an edge guide central axis 146 between the deployed position (FIG. 3A) and the retracted position (FIG. 3B).

It will be noted that the edge guide roller axis 140 is orthogonal to the edge guide central axis 146 irrespective of the rotational position of the central body 134, but this is merely exemplary and not necessarily limiting. It will further be noted that, in the deployed position, the edge guide roller axis 140 is orthogonal to the roller axes about which each of the belt rollers 116A, 116B, 116C rotate. In the retracted position, however, the edge guide roller axis 140 is non-orthogonal (skewed) to these roller axes.

Referring again to FIG. 3A, when the rotatable edge guide 130 is moved to the deployed position, the roller members 136A, 136B are each positioned to contactingly engage the cutting edge of a cutting tool during respective sharpening operations using the stationary tool support guides 122A, 122B. The roller members 136A, 136B rotate about the edge guide roller axis 140 as the cutting edge is drawn across the associated planar extent 114A, 114B of the abrasive member 114.

When moved to the retracted position, the roller members 136A, 136B are positioned to provide a non-contacting clearing relation with the cutting edge of the tool during such sharpening operations. The retracted position provides clearance for finger guards or other features that would otherwise mechanically interfere with the presentation of the cutting tool against the abrasive member. It will be noted that at least roller member 136A is a first distance from the corresponding guide member 122A in the deployed position and a second, greater distance from the guide member 122A in the retracted position.

At this point it will be noted that the edge guide 130 is referred to herein as "rotatable" due to the rotating nature of the roller supports supplied in the deployed position, not necessarily because the edge guide 130 can be rotated between the deployed and retracted positions. Other translational movement paths, including non-rotational paths (e.g., linear paths, etc.), can be used to transition the rotatable edge guide 130 between the deployed and retracted positions.

Figure 5A:
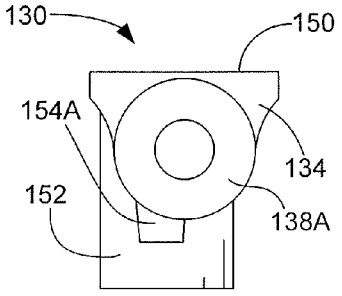
FIGS. 5A and 5B depict respective end and side views of the rotatable edge guide.
Figure 5B:
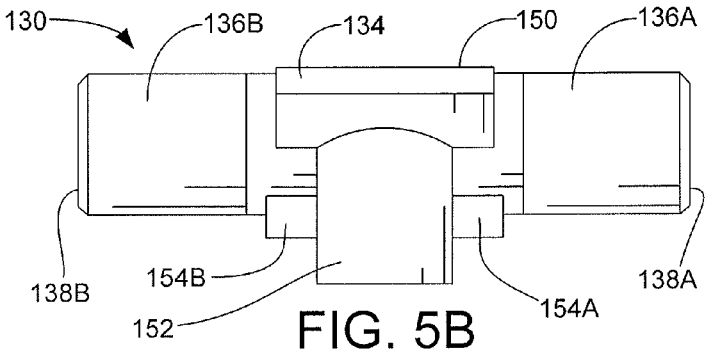

FIGS. 5A and 5B show the rotatable edge guide 130 in greater detail. The central body 134 includes a planar face plate 150 to enable a user to grasp and manipulate the rotatable edge guide 130. A threaded boss 152 extends downwardly from the face plate 150 to threadingly receive the shaft fastener 142 (FIG. 4). A pair of cam flanges 154A, 154B ("cams") flank the boss 152 and serve as travel and locking features for the rotatable edge guide 130.

A transition sequence is illustrated in FIGS. 6A-6D to show how the rotatable edge guide 130 can be moved between the deployed and retracted positions. The base structure plate 132 includes opposing cam surfaces 156A-156B with notches 158A, 158B on opposing sides of the central axis 146 (see FIG. 4). Only the cam surface 156A and notch 158A are visible in FIGS. 6A-6D, but the sequence steps shown therein are concurrently carried out on the opposing second side of the guide using the cam surface 156B and the notch 158B.

Figure 6A:
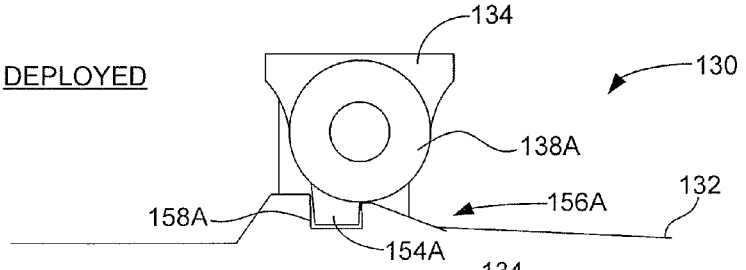
FIGS. 6A-6D show a movement sequence used to move the rotatable edge guide between the deployed and retracted positions in accordance with some embodiments.
Figure 6B:
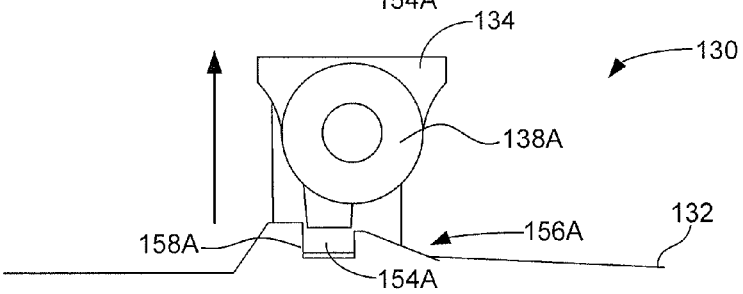

Initially, as shown in FIG. 6A the notch 158A nestingly receives and retains the cam flange 154A in the deployed position. This serves as a locking mechanism to retain the edge guide 130 in the deployed position. To transition the edge guide 130 to the retracted position, the user grasps the plate 150 and pulls the central body 134 away from the base structure plate 132 so that the cam flange 154A is retracted from the notch 158A, as depicted in FIG. 6B. This retraction by the user overcomes the bias force applied to the central body 134 by the biasing member 144 (FIG. 4).

Figure 6C:
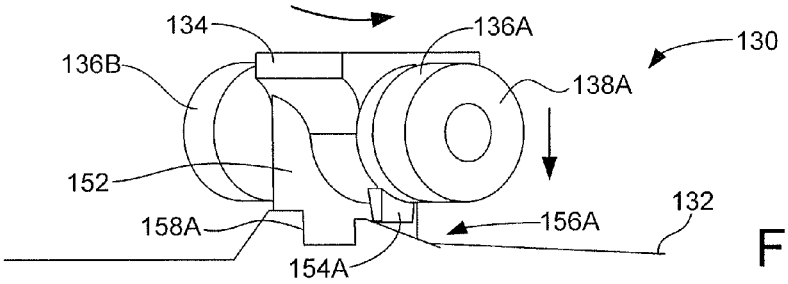

The user next rotates the central body 134 about the central axis 146 (FIG. 4) in the direction shown in FIG. 6C. This allows the cam flange 154 to contactingly travel along the cam surface 156A. As the central body 134 is rotated, the edge guide 130 will continuously retract toward the base structure plate 132 as the cam flange moves along the ramped cam surface.

Figure 6D:
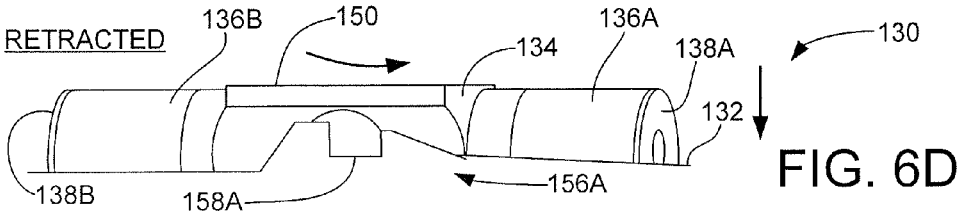

Finally, as shown in FIG. 6D, upon sufficient rotation and retraction of the central body 134, the rotatable edge guide 130 will be pulled into a full body retention notch 160 (best viewed in FIG. 4) by the biasing member (spring) 144. The sidewalls of the retention notch 160 will serve as a locking mechanism to lock the rotatable edge guide 130 in the retracted position. The sequence steps of FIGS. 6A-6D are reversed to return the rotatable edge guide 130 to the deployed position.

Figure 7A:
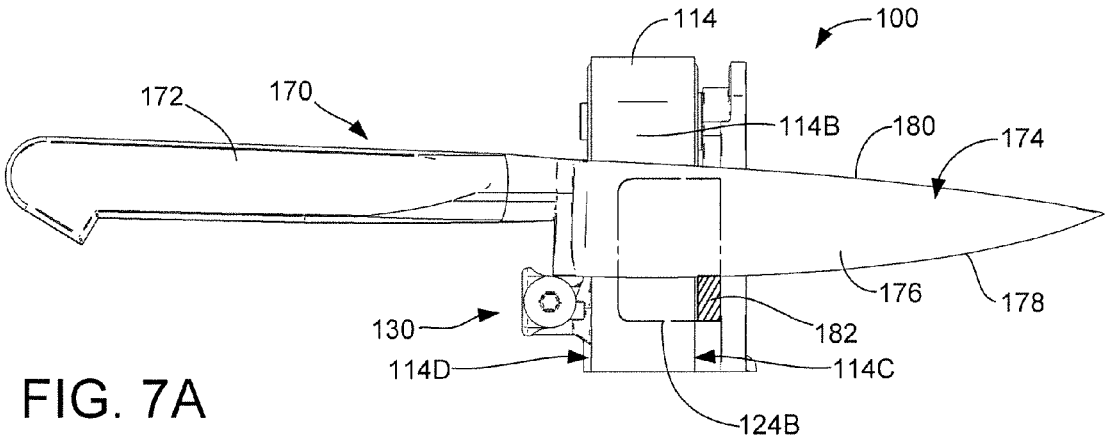
FIGS. 7A-7C show a sharpening sequence on an exemplary cutting tool with the rotatable edge guide in the deployed position.
Figure 7B:
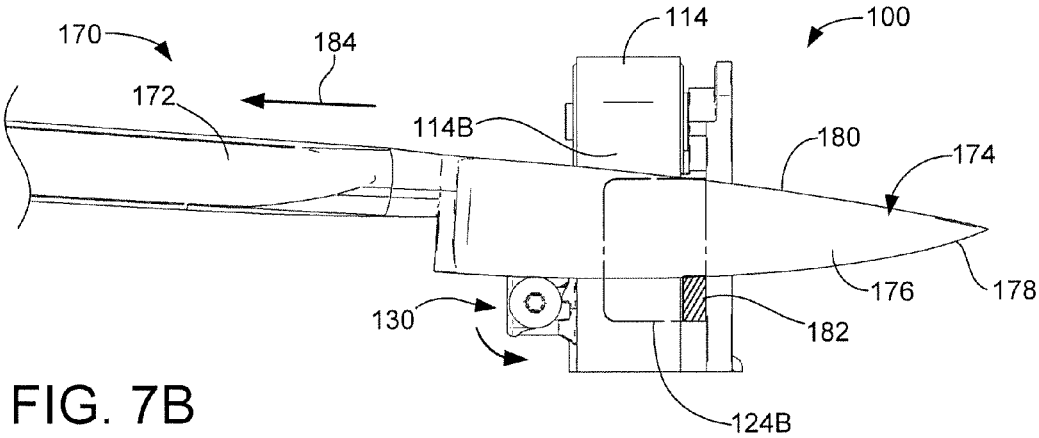
Figure 7C:
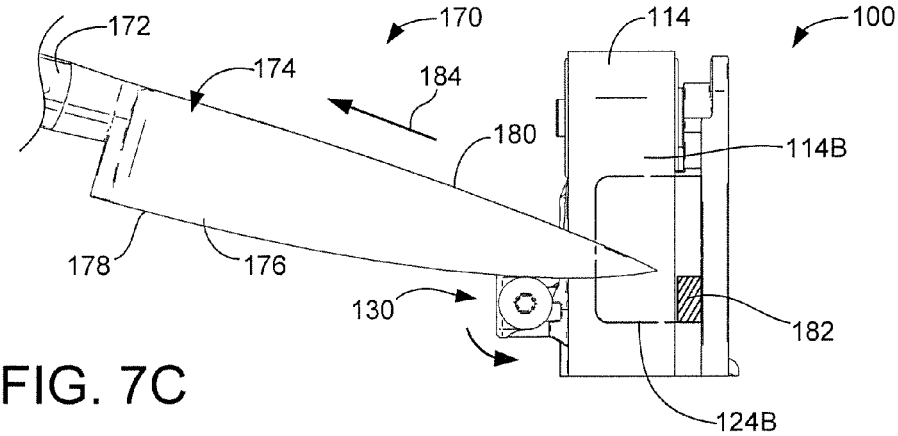

FIGS. 7A-7C depict a sharpening sequence upon an exemplary cutting tool 170 using the rotatable edge guide 130 in the deployed position of FIG. 6A. The cutting tool is characterized as a kitchen knife with a user grippable handle 172 and a blade portion 174 which extends from the handle 172. The blade portion 174 includes opposing first and second side surfaces, only one of which is visible and denoted in FIGS. 7A-7C at 176.

A cutting edge 178 extends along the length of the blade portion 174 and is defined along the converging intersection of the opposing side surfaces. A top surface 180 is provided opposite the cutting edge 178. The top surface 180 remains non-contactingly supported during sharpening using the sharpener 100, thereby providing clearance to permit a wide variety of sizes and shapes of tools to be sharpened, as well as accommodating rotational retractional movement of the knife 170 during sharpening, as will now be described.

To begin the sharpening sequence, as depicted in FIG. 7A a user grasps the handle 172 and inserts the blade portion 174 into the clearance gap between the planar extent 114A of the abrasive member 114 and the guide surface 124B. The user lowers the cutting edge 178 so that a distal end of the cutting edge opposite the handle 172 contactingly engages the stationary edge guide 182 and a proximal end of the cutting edge adjacent the handle contactingly engages the rotatable edge guide 130. It can be seen from FIG. 7A that the abrasive member 114 extends between the stationary edge guide 182 and the rotatable edge guide 130 so that the stationary edge guide 182 supports the distal end of the cutting edge adjacent a first edge (side) 114C of the abrasive member 114, while the rotatable edge guide 130 concurrently supports the proximal end of the cutting edge of the tool adjacent an opposing second edge (side) 114D of the abrasive member 114.

Concurrently, the knife 130 is rotated about its longitudinal axis (e.g., length from end of handle to end of blade) as required to bring a portion of the side surface 176 into contacting planar alignment with the guide surface 124B. The abrasive member 114 can be rotating along its associated belt path during this insertion phase or rotation can be subsequently initiated by the user.

Once aligned, the cutting edge 178 contactingly engages the planar extent 114A of the abrasive member 114 and relative movement of the abrasive surface adjacent the tool will induce sharpening of the cutting edge. Some deflection of the abrasive member 114 may occur during such contact, as will be explained below.

As shown by FIG. 7B, the user slowly retracts the knife 170 along a retraction path (arrow 184) while maintaining the side surface 176 in contacting engagement, via sliding contact, against the guide surface 124B. The cutting edge is maintained in contacting engagement, via sliding contact, against the stationary edge guide 182, and in contacting engagement, via rolling contact, against the rotatable edge guide 130. This sequentially presents substantially the entire length of the cutting edge 178 against the abrasive surface.

The rolling contact provided by the rotatable edge guide 130 reduces the propensity for the associate roller member to dull that portion of the cutting edge that has already been presented against the abrasive surface. It will be noted that the stationary edge guide 182 can also be configured as a rolling guide as desired.

As further shown by FIG. 7C, the user continues to retract the knife 170 so that at some point the cutting edge will no longer contactingly engage the stationary edge guide 182, but will still be supported by the rotatable edge guide 130. The side surface 176 remains in contacting alignment against the guide surface 124B. The knife retraction path 174 can include an upwardly rotatable component to maintain the presentation angle of the cutting edge 178 in a desired relation to the abrasive surface, as shown. Multiple successive passes, such as 3-10 passes, may be applied to each side of the knife 170, and different belts may be installed to provide successively different rates of material removal, as discussed below.

Figure 8:
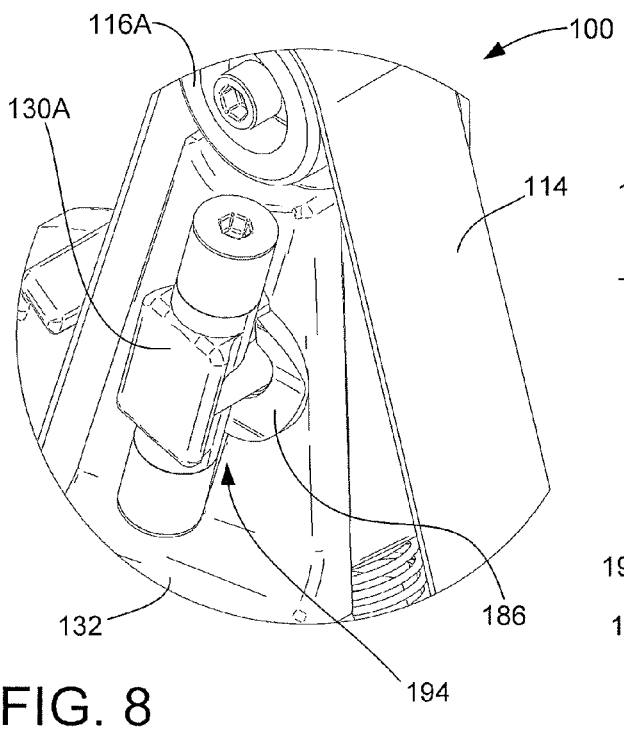
FIG. 8 shows an isometric depiction of another rotatable edge guide in accordance with an alternative embodiment in which the rotatable edge guide can further be moved to an intermediate deflected contact position between the deployed position and the retracted position.

FIG. 8 is an isometric depiction of a rotatable edge guide 130A in accordance with further embodiments. The rotatable edge guide 130A as depicted in FIG. 8 is nominally identical to and includes substantially all of the features discussed above for the rotatable edge guide 130, except that the base structure plate 132 is supplied with a different configuration to facilitate further deflection characteristics for the edge guide.

More particularly, the configuration of FIG. 8 allows the edge guide 130A to be moved to an intermediate position (a so called "deflected contact" position) where the edge guide is partially rotated about the central axis 146 (FIG. 4) but remains in contact with and continues to supply rotational support for the cutting edge of a cutting tool.

Figure 9A:
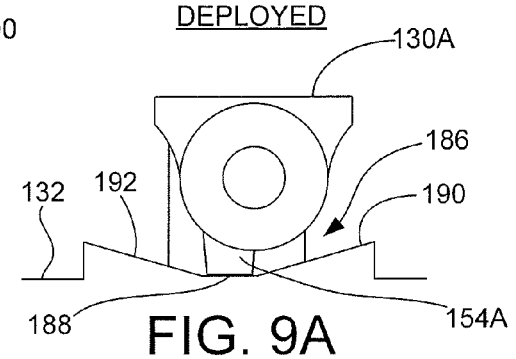
FIGS. 9A and 9B show the rotatable edge guide of FIG. 8 in the respective deployed position and deflected contact position.
Figure 9B:
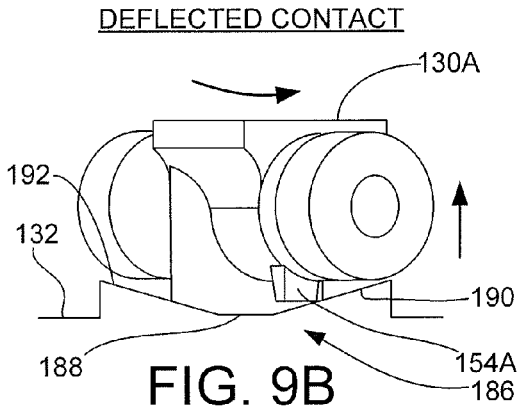

As shown in greater detail in FIGS. 9A and 9B, the plate 132 is provided with opposing cam surfaces 186 each having an intermediate base portion 188 and opposing ramps 190, 192. The base portion 188 serves as a normal resting location for the rotatable edge guide 130A in the deployed position. Rotational deflection of the rotatable edge guide 130A due to a downwardly applied force from the cutting edge of a tool causes the respective cam flanges to concurrently travel up the associated ramps (as shown for cam flange 154A and ramp 190 in FIG. 9B). As before, a retention notch 194 is supplied in the plate 132 to retain the edge guide 130 in the retracted position, as generally illustrated in FIG. 8.

Figure 10A:
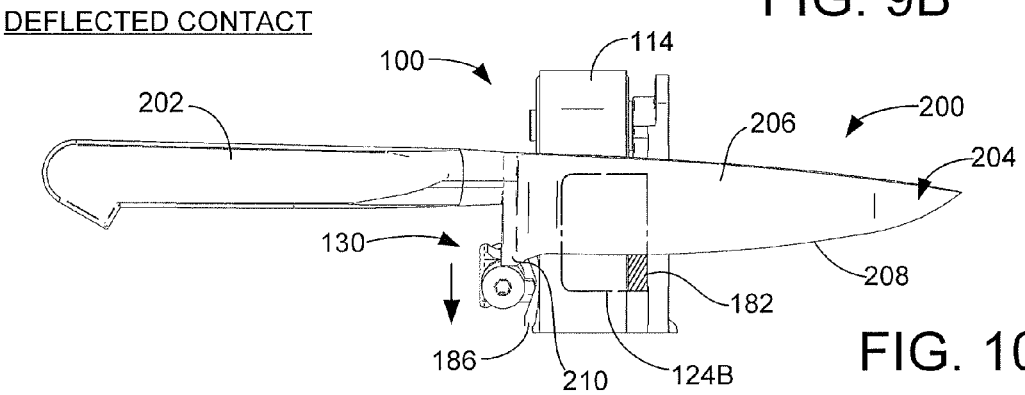
FIGS. 10A and 10B show a sharpening sequence on another exemplary cutting tool in which the rotatable edge guide is transitioned between the deflected contact position (FIG. 10A) and the deployed position (FIG. 10B).
Figure 10B:
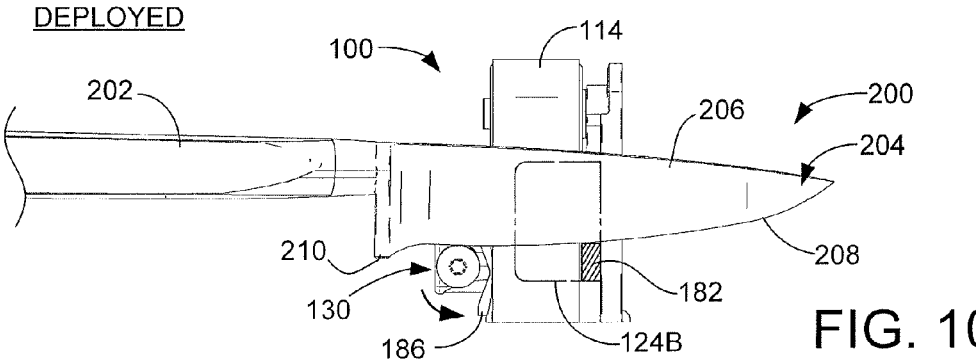

FIGS. 10A and 10B show a partial sharpening sequence for another exemplary sharpening tool 200. The tool 200 is characterized as a kitchen knife with a handle 202, blade portion 204, side surface 206 and cutting edge 208. The cutting edge 208 includes a guard projection 210 at the base of the blade. It can be seen that the contacting engagement between the guard projection 210 in FIG. 10A advances the rotatable edge guide 130A to the deflected contact position, after which the edge guide returns to the normally deployed position shown in FIG. 10B.

Figure 11:
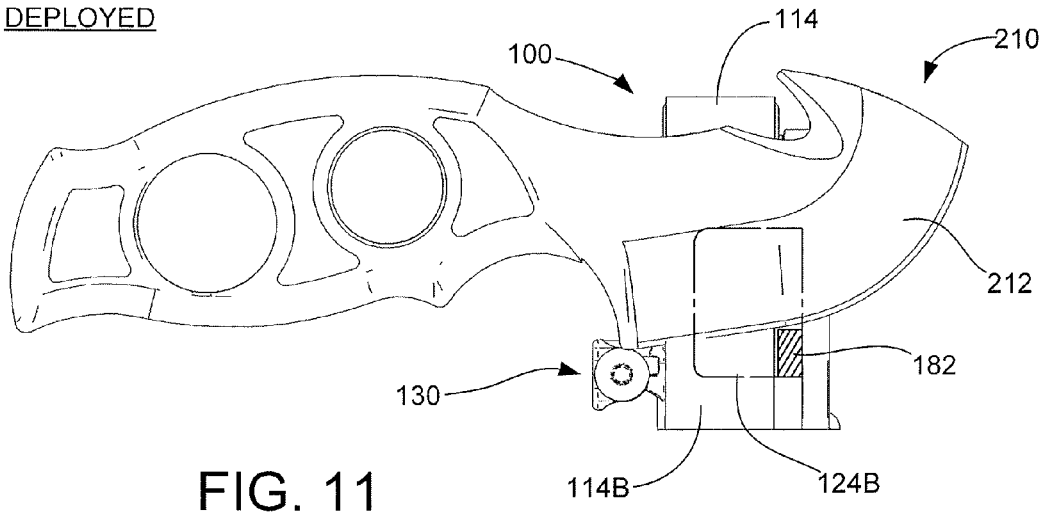
FIG. 11 shows another exemplary cutting tool having a cutting edge being presented for sharpening with the rotatable edge guide in the deployed position.
Figure 12:
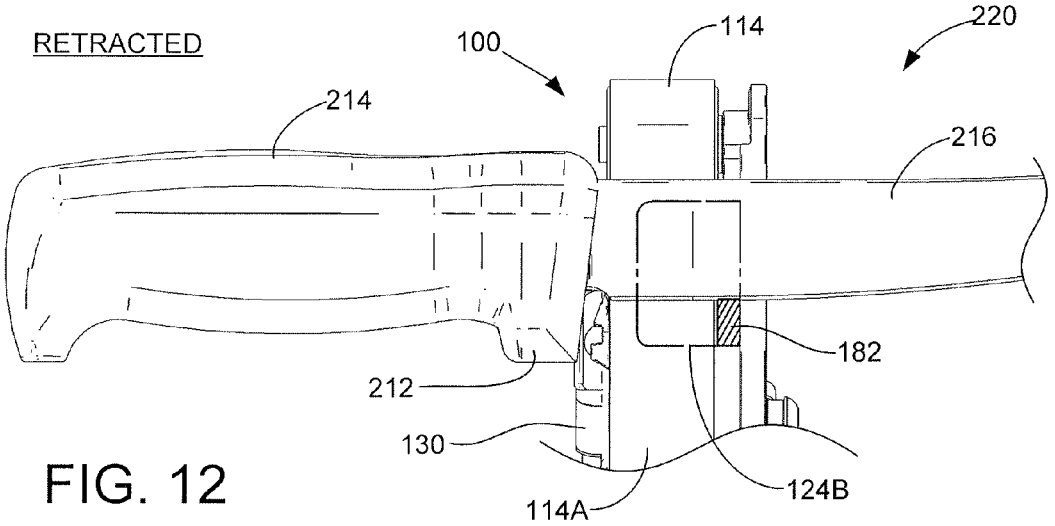
FIG. 12 shows yet another exemplary cutting tool having a cutting edge being presented for sharpening with the rotatable edge guide in the retracted position.

As noted above, the translational movement of the rotatable edge guide 130, 130A disclosed herein allows a wide variety of different types and styles of cutting tools to be sharpened using the tool sharpener 100. FIG. 11 illustrates a utility tool 210 with a circuitous blade 212 that can be sharpened using the rotatable edge guide 130 in the deployed position. FIG. 12 shows a fillet knife 210 with a finger guard 212 extending from a handle 214. Movement of the rotatable edge guide 130 to the retracted position provides the necessary clearance to enable a blade 216 of the knife 210 to be readily sharpened.

Figure 13A:
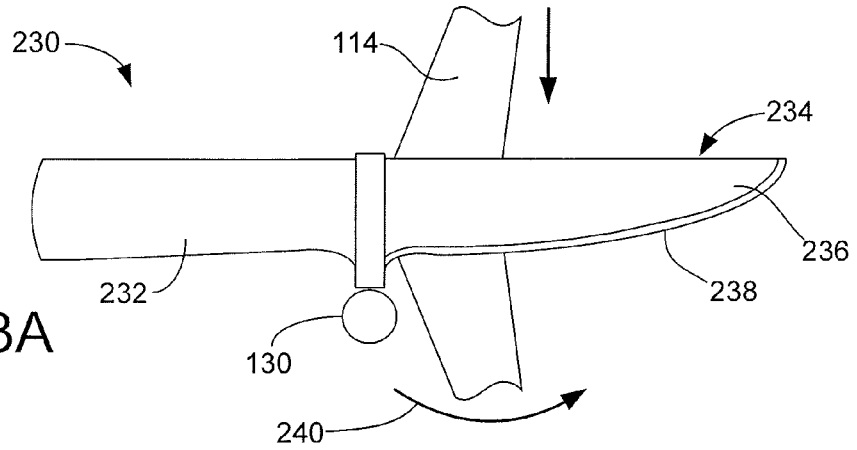
FIGS. 13A and 13B illustrate a first mode of deflection of the abrasive member of the sharpener of FIG. 1 during a sharpening operation on another exemplary cutting tool to conform to a shape of the cutting edge of the tool.
Figure 13B:
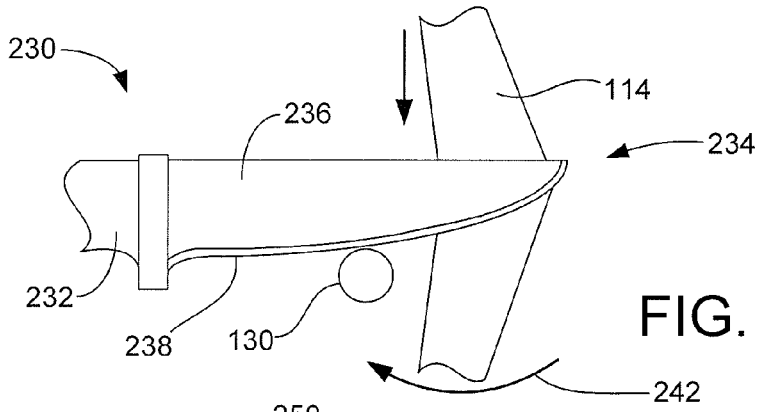

FIGS. 13A and 13B generally illustrate a first deflection mode of the abrasive medium 114 during sharpening using the tool sharpener 100 in accordance with some embodiments. An exemplary cutting tool (kitchen knife) 230 includes a handle 232, blade portion 234, side surface 236 and cutting edge 238. The abrasive belt 114 twists out of its normally aligned neutral plane (e.g., out of the normally presented planar extent) in the vicinity of the knife 200 as the cutting edge 238 is drawn across the belt. This deflection is represented by torsion arrow 240. Generally, the moving belt 114 will undergo localized torsion (twisting) to maintain a nominally constant angle between the abrasive surface and the cutting edge 238, so that greater changes in the curvilinearity of the cutting edge (e.g., 238) will tend to increase the amount of torsional deflection of the belt 114.

In this way, a constant and consistent grinding plane can be maintained with respect to the blade material and shape. A first amount of torsion in a generally counter-clockwise direction occurs near the handle 232 as shown by FIG. 13A, and a second amount of torsion in a generally clockwise direction (torsion arrow 242) occurs near the blade tip as shown in FIG. 13B. As noted above, these changes are induced responsive to changes in the curvilinearity of the cutting edge 238.

Figure 14A:
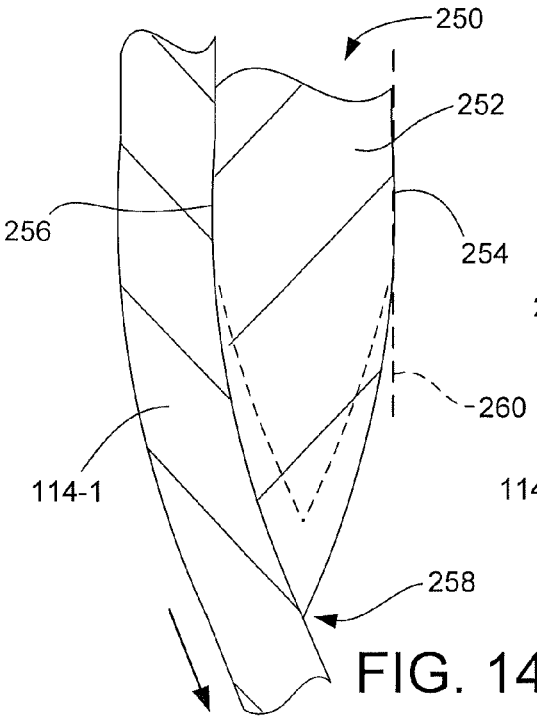
FIGS. 14A and 14B illustrate a second mode of deflection of the abrasive member of the sharpener of FIG. 1 during a sharpening operation on another exemplary cutting tool.
Figure 14B:
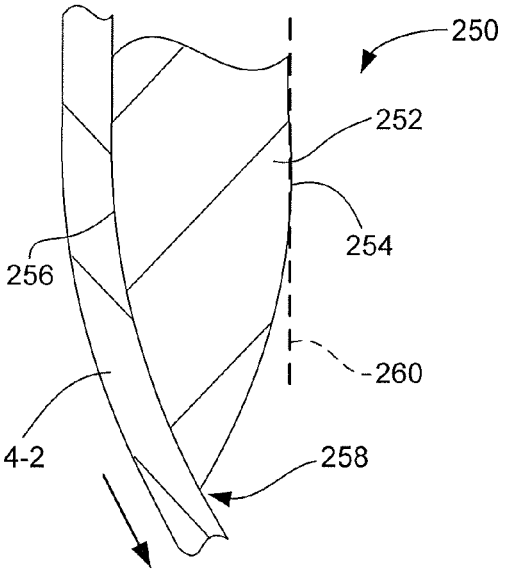

FIGS. 14A and 14B generally illustrate a second deflection mode of abrasive medium 114 during sharpening using the tool sharpener 100 in accordance with some embodiments. The sharpener 100 provides a convex grind surface geometry to a cutting tool (knife) 250. FIG. 14A shows a blade portion 252 of the knife with side surfaces 254, 256 and cutting edge 258. The side surface 254 is contactingly aligned against the associated guide surface of the stationary guide assembly 120 to align the side surface 254 along a selected guide plane 260. A portion of the side surface 256 contactingly engages a first abrasive medium (belt) 114-1.

When alternately applied to opposing sides of the blade 252, the first abrasive medium 114-1 provides continuously extending, substantially convex surfaces along sides 254, 256 which converge and intersect to form the cutting edge 258. The first abrasive medium 114-1 is characterized as an endless abrasive belt having a relatively coarse abrasive level, and relatively high linear stiffness characteristics.

FIG. 14B shows a subsequent grinding operation upon the blade portion 252 of the knife 250 a second abrasive medium 114-2. The second abrasive medium 114-2 is also characterized as an endless abrasive belt with a relatively fine abrasive level and a relatively lower linear stiffness. This allows the second belt 114-2 to induce a smaller radius of curvature as compared to the first belt 114-1, providing the blade with a compound convex geometry that provides an extremely sharp final cutting edge 258.

It is contemplated in some embodiments that sharpening operations can be carried out as discussed above using a first belt such as 114-1 to provide a coarse grinding operation, followed by replacement of the first belt with a second belt such as 114-2 to provide a fine grinding (honing) operation. The rotatable edge guide 130 and stationary guide assembly 120 can be used to provide support during these and other types of sharpening operations.

Figure 15:
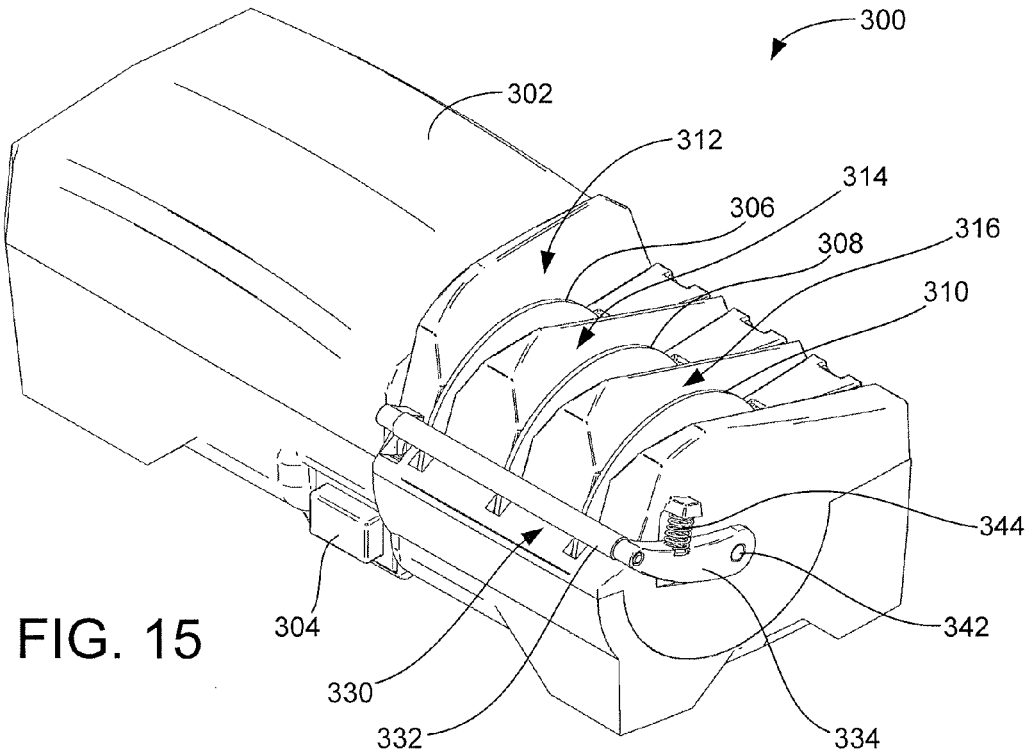
FIG. 15 is an isometric depiction of another tool sharpener constructed in accordance with some embodiments of the present disclosure.

While various embodiments set forth above have provided rotatable edge guide arrangements in the context of an endless abrasive belt, the arrangements can further be adapted for other forms of abrasive media, such as but not limited to rotatable abrasive disks. FIG. 15 is an isometric depiction of another tool sharpener 300 constructed and operated in accordance with various embodiments of the present disclosure.

As explained below, the tool sharpener 300 is adapted to sharpen a wide variety of different styles and types of cutting tools using a sequence of sharpening stations, each adapted to accommodate a different type of sharpening operation. In some embodiments, the stations can be used to provide multi-stage sharpening as discussed above in FIGS. 14A-14B, but through the use of rotating abrasive disks rather than endless abrasive belts.

In other embodiments, the stations can be used to accommodate sharpening operations on different types of tools requiring different presentation angles, such as kitchen knives and scissors, etc. Regardless, the various operational features discussed above for the tool sharpener 100 are incorporated and adapted into the tool sharpener 300, as will now be explained.

The tool sharpener 300 includes a base structure 302 which encloses and/or supports various features of interest, including an electrical motor (not separately shown) to provide motive power during the sharpening operation. A user activated switch 304 can be used to selectively activate the powered operation of the sharpener.

A number of abrasive members, in this case three (3), are shown at 306, 308 and 310. The abrasive members 306, 308, 310 are supported within the interior of the base structure 302 and are respectively characterized as rotatable abrasive disks with abrasive surfaces supplied on opposing sides thereof. It is contemplated that the abrasive surfaces each have respective planar extents that extend along a neutral plane during operation of the sharpener 300 to accommodate the presentation of the cutting edge of a tool during a sharpening operation. The abrasive surfaces may have a common abrasiveness level, or may be different from one disk to the next.

The abrasive disks can be formed of any suitable material and may be rigid, axially deflectable and/or radially deformable. In some embodiments the disks are flexible ("floppy") so that, when at rest, the flexible disks rest in a somewhat deformed, bent and/or quasi-folded position due to the force of gravity. Once rotation is initiated, however, the disks quickly transition to the aforementioned neutral plane due to centripedal forces induced by disk rotation. The use of flexible disks may impart similar deformation modes as discussed above in FIGS. 13A-14B and allow the generation of complex concave grind geometries.

Figure 16:
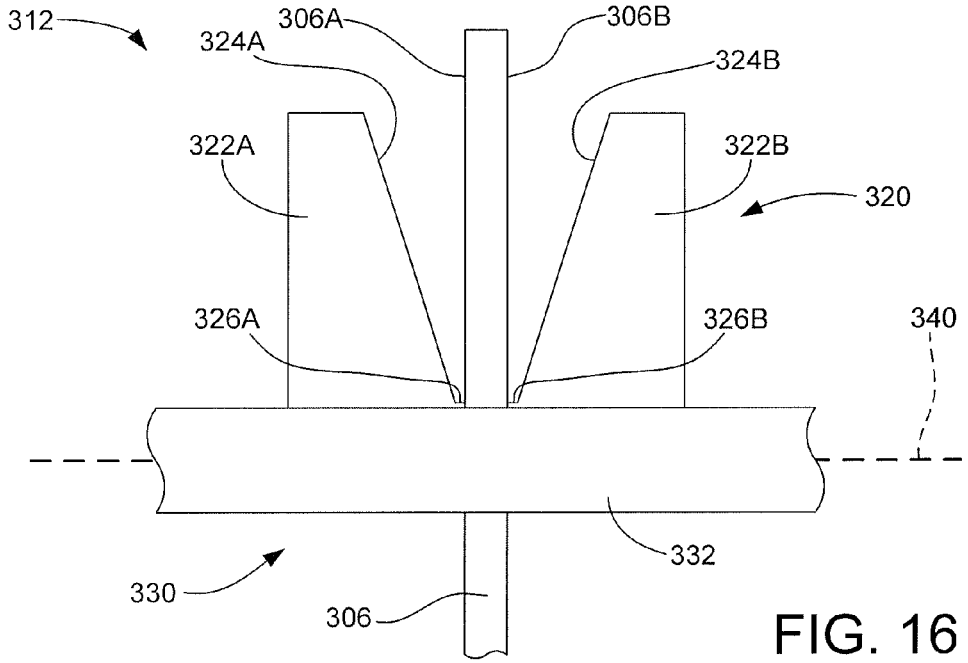
FIG. 16 shows aspects of a selected sharpening stage of the tool sharpener of FIG. 15.

As noted above, each disk 306, 308, 310 forms a portion of a separate sharpening station 312, 314 and 316, with each sharpening station accommodating double sided sharpening. Detailed aspects of the sharpening station 312 are generally depicted in FIG. 16. It will be appreciated that the other sharpening stations 314, 316 can be provisioned with similar features and therefore separate illustration and discussion of these stations will be omitted for clarity.

As shown in FIG. 16, the sharpening station 312 includes a sharpening guide assembly 320 adjacent opposing planar extents 306A, 306B of disk 306. The sharpening guide assembly 320 includes a pair of opposing, stationary sharpening guides 322A, 322B. As before, the stationary sharpening guides 322A, 322B have respective guide surfaces 324A, 324B which extend along respective guide planes at a common, fixed acute angle with respect to the neutral planes of the planar extents 306A, 306B. The guide surfaces 324A, 324B contactingly support the respective side surfaces of a cutting tool during a double-sided sharpening operation as the cutting tool is presented against each guide surface in turn. As desired, stationary edge guides 326A, 326B can be provided as shown.

As with the guide assembly 120 discussed above, the guide assembly 320 can be configured to be adjustable to selectively set the guide surfaces 324A, 324B to a selected common fixed angle. However, in other embodiments the angle of each station is not adjustable. The angle of each station may vary from one station to the next. For example, station 312 may be set at nominally 20 degrees, station 314 may be set at nominally 25 degrees, and station 316 may be set at nominally 40 degrees. Other respective values can be used as desired.

Referring again to FIG. 15, the tool sharpener 300 is further provisioned with a rotatable edge guide 330 to provide cutting edge support during sharpening operations in a manner as generally set forth above. The rotatable edge guide 330, however, is configured as a continuous roller member 332 which spans each of the sharpening stations 312, 314 and 316. The roller member 332 is supported by a central body 334 and is adapted to rotate about an edge roller axis 340.

As before, the roller member 332 is formed of a compliant material to enhance rolling contact between the roller member 332 and the cutting tool during a sharpening operation. The rotatable edge guide 330 is further configured for rotation about an edge guide central axis established by a pivot member 342 secured to the base structure 302. A biasing member (e.g., coiled spring) 344 supplies a biasing force upon the central body 334.

Figures 17A, 17B, 17C:
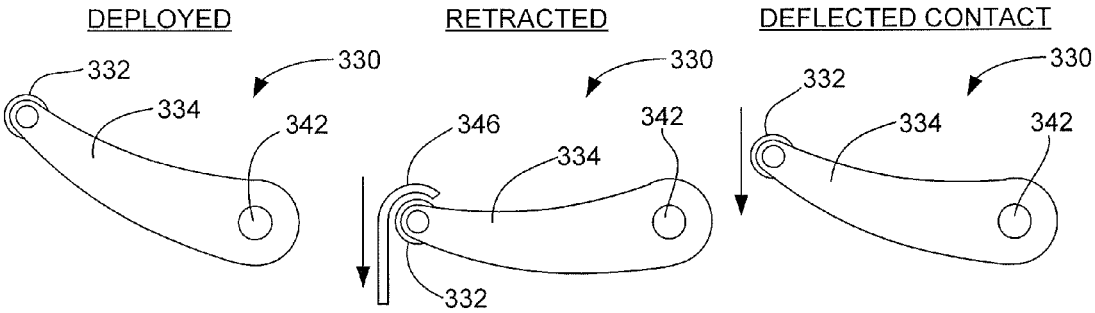
FIGS. 17A-17C show different positional modes of a rotatable edge guide of the tool sharpener of FIG. 15.

In this way, as shown in FIGS. 17A-17C, the rotatable edge guide 330 can be transitioned between a deployed position (FIG. 17A), a retracted position (FIG. 17B) and a deflected contact position (17C). As desired, a locking mechanism such as a retention tab member 346 can be used to retain the edge guide 330 in the retracted position. The locking mechanism can take any suitable form and need not necessarily engage the roller 332; instead, other portions of the edge guide 330 can be engaged. A detent switch arrangement can be used so that the user pushes the roller member 332 down a first time to lock the roller member in the retracted position, and then pushes the roller member down a second time to release the roller member and allow the biasing member 344 to return the roller member to the deployed position.

It will be noted that the edge roller axis 340 is nominally parallel to the axis of rotation of the disks 306, 308 and 310, and is also nominally parallel to the edge guide central axis of pivot 342, during all positional modes. The roller member 332 is a first distance from the respective guide members (e.g., 332A, 332B) in the deployed position and a second, greater distance from the respective guide members in the retracted position.

Figure 18A:
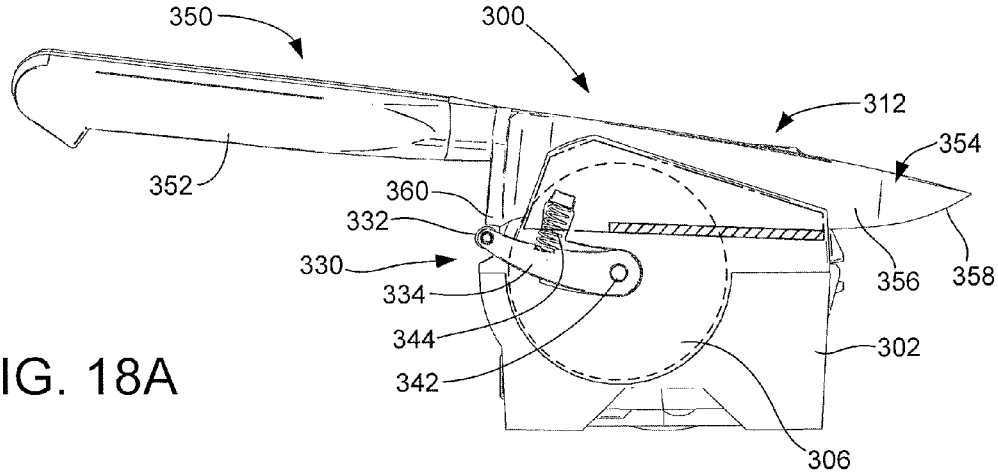
FIGS. 18A and 18B are side elevational representations of the tool sharpener of FIG. 15 during a sharpening sequence in which another rotatable edge guide is transitioned between an intermediate deflected contact position and a deployed position.
Figure 18B:
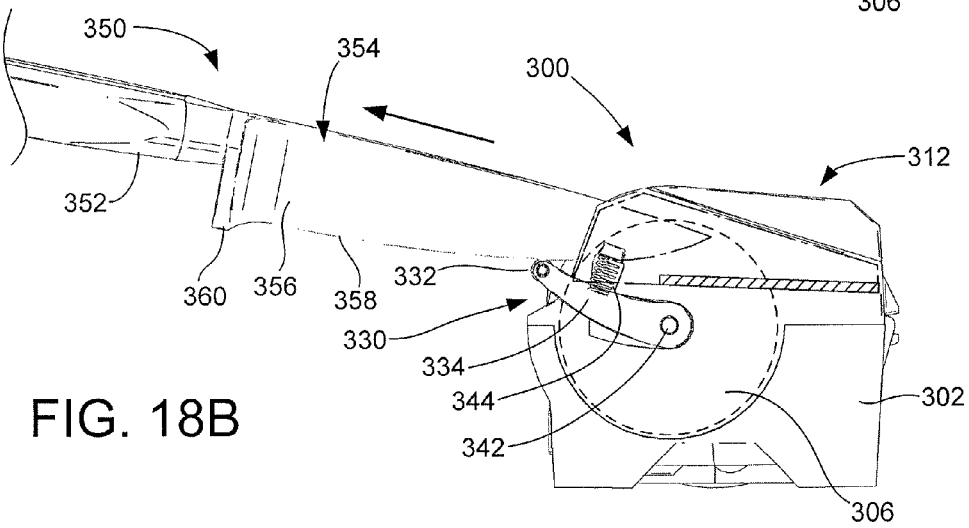

FIGS. 18A and 18B generally illustrate a sharpening sequence upon another exemplary cutting tool 350 using the tool sharpener 300. The cutting tool 350 is characterized as a kitchen knife and includes handle 352, blade portion 354, opposing side surfaces (one of which is shown at 356), cutting edge 358, and guard projection 360 which extends from the cutting edge 358.

In a manner similar to the sharpening operations discussed above, the user inserts the knife 350 into the appropriate slot and brings a portion of the side surface 356 into contacting engagement with the associated guide surface (such as guide surface 324B in FIG. 16). The cutting edge 358 is rotatably supported by the roller member 332 and, as desired, a stationary edge guide (e.g., 326A, 326B in FIG. 16) on an opposing side of the disk 306. FIG. 18A shows translation of the roller edge guide 330 to the deflected contact position to accommodate the guard projection 360, and FIG. 18B shows translation of the roller edge guide 330 to the deployed position.

It will now be appreciated that the various embodiments presented herein provide a number of benefits over the art. The use of a rotating edge guide advantageously provides mechanical support, via rolling non-dulling contact, the cutting edge during a sharpening operation. The edge guide allows precise location of the cutting tool relative to the abrasive member over repeated sharpening passes. The translational aspects of the edge guide further allow the roller to be fully retracted out of the way as needed, and in some cases, partially deflected to accommodate guard projections and other features that would otherwise tend to interfere with the sharpening process.

While motor-driven powered sharpeners have been disclosed herein, such is merely exemplary and is not limiting.

Any number of different types of sharpener configurations can employ the various features exemplified herein, including sharpeners that do not employ a motor-driven abrasive surface.

It is to be understood that even though numerous characteristics and advantages of various embodiments of the present disclosure have been set forth in the foregoing description, together with details of the structure and function of various embodiments thereof, this detailed description is illustrative only, and changes may be made in detail, especially in matters of structure and arrangements of parts within the principles of the present disclosure to the full extent indicated by the broad general meaning of the terms in which the appended claims are expressed.

What is claimed is:

1. A tool sharpener for sharpening a cutting tool, the tool sharpener comprising:

an abrasive medium having an abrasive surface;

a stationary tool support guide adjacent a first edge of the abrasive medium having a side guide surface extending along a guide plane at a selected angle with respect to the abrasive surface to engage, via sliding contact, a side of the tool during presentation of a cutting edge of the tool against the abrasive surface; and a rotatable edge guide adjacent an opposing, second edge of the abrasive medium so that the abrasive medium extends between the rotatable edge guide and the stationary tool support guide, the rotatable edge guide comprising a roller member having a curvilinearly extending outer surface rotatable about an edge guide roller axis, the roller member moveable between a deployed position and a retracted position, the deployed position of the rotatable edge guide configured to facilitate contacting support of a proximal end of the cutting edge of the tool by the curvilinearly extending outer surface of the roller member adjacent the second edge of the abrasive medium during concurrent support of the side of the tool by the stationary tool support guide adjacent a distal end of the cutting tool adjacent the first edge of the abrasive medium to sharpen the cutting edge, the retracted position of the rotatable edge guide configured to place the curvilinearly extending outer surface of the roller member in a non-contacting, clearing relation with respect to the tool during support of the side of the tool by the stationary tool support guide adjacent the distal end of the cutting tool adjacent the first edge of the abrasive member to sharpen the cutting edge.

2. The tool sharpener of claim 1, wherein the curvilinear extending outer surface is a first overall distance from the stationary tool support guide in the deployed position and a second overall distance greater than the first overall distance from the stationary tool support guide in the retracted position.

3. The tool sharpener of claim 1, wherein the edge guide roller axis intersects the guide plane at a first angle in the deployed position and a second angle less than the first angle in the retracted position.

4. The tool sharpener of claim 1, wherein the rotatable edge guide further comprises a central body which supports the roller member, the central body rotatable with respect to the stationary tool support guide between the deployed position and the retracted position about an edge guide central axis.

5. The tool sharpener of claim 4, wherein the edge guide central axis is orthogonal to the edge guide roller axis.

6. The tool sharpener of claim 4, wherein the edge guide central axis is parallel to the edge guide roller axis.

7. The tool sharpener of claim 4, further comprising a base structure which supports the rotatable edge guide, the base structure having a cam surface along which a cam member of the central body contactingly slides as the central body rotates about the edge guide central axis.

8. The tool sharpener of claim 1, further comprising a biasing member which applies a biasing force upon the roller member to respectively retain the roller member in the deployed position and in the retracted position.

9. The tool sharpener of claim 1, wherein the curvilinearly extending outer surface is a cylindrical surface.

10. The tool sharpener of claim 1, further comprising a base structure which supports the rotatable edge guide, the base structure having a first locking surface to contactingly engage the rotatable edge guide to retain the roller member in the deployed position and a second locking surface to contactingly engage the rotatable edge guide to retain the roller member in the retracted position.

11. The tool sharpener of claim 1, further comprising a biasing member which applies a biasing force to the rotatable edge guide to nominally urge the rotatable edge guide to the deployed position, wherein the rotatable edge guide is further deflectable to a deflected contact position between the deployed position and the retracted position by applying a deflection force to the roller member that overcomes the biasing force, wherein the deflected contact position is arranged to contactingly engage the cutting edge of the tool during said presentation.

12. The tool sharpener of claim 1, wherein the roller member is formed of a compliant material to provide a desired level of friction between the roller member and the cutting edge to facilitate rotational movement of the roller during retraction of the tool.

13. The tool sharpener of claim 1, wherein the stationary tool support guide further comprises a stationary edge guide configured to contactingly engage the cutting edge of the tool during said support of the side of the tool by the stationary tool support guide adjacent the distal end of the cutting tool adjacent the first edge of the abrasive member to sharpen the cutting edge.

14. The tool sharpener of claim 1, wherein the abrasive medium comprises an endless abrasive belt routed about at least one belt roller along a belt path that passes adjacent the stationary tool support guide, wherein the at least one belt roller rotates about a belt roller axis, and wherein the edge guide roller axis is orthogonal to the belt roller axis in the deployed position.

15. The tool sharpener of claim 1, wherein the abrasive medium comprises an abrasive disk which rotates about a disk rotational axis, wherein the edge guide roller axis is parallel to the disk rotational axis in the deployed position.

16. A tool sharpener for sharpening a tool, the tool sharpener comprising:

a base structure which encloses an electric motor;

an abrasive medium supported by the base structure and adapted for rotational movement responsive to the electric motor, the abrasive medium having an abrasive surface extending along a neutral plane;

a stationary tool support guide having a guide surface extending along a guide plane at a selected angle with respect to the neutral plane to engage, via sliding contact, a side of the tool during presentation of a cutting edge of the tool against the abrasive surface, the stationary tool support guide disposed adjacent a first edge of the abrasive medium; and a rotatable edge guide disposed adjacent an opposing, second edge of the abrasive medium so that the abrasive medium is disposed between the rotatable edge guide and the stationary tool support guide, the rotatable edge guide comprising a roller member having a curvilinearly extending outer surface rotatable about an edge guide roller axis, the rotatable edge guide further rotatable about an edge guide central axis between a deployed position and a retracted position, wherein in the deployed position the roller member is a first distance from the guide surface to facilitate contacting support of a proximal end of the cutting edge of the tool by the curvilinearly extending outer surface of the roller member adjacent the second edge of the abrasive medium during concurrent support of the side of the tool by the stationary tool support guide adjacent a distal end of the cutting tool adjacent the first edge of the abrasive medium to sharpen the cutting edge, and wherein in the retracted position the roller member is a second distance from the guide surface greater than the first distance to place the curvilinearly extending outer surface of the roller member in a non-contacting, clearing relation with respect to the tool during support of the side of the tool by the stationary tool support guide adjacent the distal end of the cutting tool adjacent the first edge of the abrasive member to sharpen the cutting edge.

17. The tool sharpener of claim 16, wherein the base structure comprises a cam surface and the rotatable edge guide comprises a cam flange, wherein the cam flange contactingly slides along the cam surface as the rotatable edge guide is rotated between the deployed position and the retracted position.

18. The tool sharpener of claim 16, wherein the abrasive medium comprises an endless abrasive belt routed about at least one belt roller along a belt path that passes adjacent the stationary tool support guide, wherein the at least one belt roller rotates about a belt roller axis, and wherein the edge guide roller axis is orthogonal to the belt roller axis in the deployed position.

19. The tool sharpener of claim 16, wherein the abrasive medium comprises an abrasive disk which rotates about a disk rotational axis, wherein the edge guide roller axis is parallel to the disk rotational axis in both the deployed position and in the retracted position.

20. The tool sharpener of claim 16, wherein the stationary tool support guide further comprises a stationary edge guide configured to contactingly engage the cutting edge of the tool during said support of the side of the tool by the stationary tool support guide adjacent the distal end of the cutting tool adjacent the first edge of the abrasive member to sharpen the cutting edge.

21. A tool sharpener for sharpening a tool, the tool sharpener comprising:

an endless abrasive belt having an abrasive surface and opposing first and second sides, the belt routed over a belt roller and placed under tension to present a planar extent of the belt adjacent the roller, the roller rotatable about a first axis;

a stationary tool support guide adjacent the first side of the belt and having a guide surface extending along a guide plane at a selected angle with respect to the planar extent of the belt to engage, via sliding contact, a side of the tool during presentation of a cutting edge of the tool against the abrasive surface of the belt; and a rotatable edge guide adjacent the second side of the belt and comprising a roller member having a curvilinearly extending outer surface rotatable about a second axis and a main body which supports the roller member and which is rotatable about a third axis parallel to the first axis to transition the roller member between a deployed position and a retracted position, the deployed position placing the second axis orthogonal to the first axis to engage, via rolling contact, a proximal portion of the cutting edge during concurrent contact of the side of the tool by the guide surface of the stationary tool, the retracted position placing the second axis in a skewed relation to the first axis so that the roller member is in a non-contacting clearing relation to the tool during contact of the side of the tool by the guide surface of the stationary tool.

22. The tool sharpener of claim 21, wherein the belt roller is a first belt roller, and wherein the tool sharpener further comprises a second belt roller and a third belt roller, the belt routed around the first, second and third belt rollers.

23. The tool sharpener of claim 21, wherein the main body comprises a cam flange which engages a cam surface of an adjacent support structure during rotation of the main body about the third axis, the support structure further comprising a first locking surface against which the rotatable edge guide contactingly abuts to secure the rotatable edge guide in the retracted position.

24. The tool sharpener of claim 21, further comprising a stationary edge guide disposed adjacent the first side of the belt, the stationary edge guide configured to contactingly support a proximal portion of the cutting edge during said presentation thereof against the abrasive surface.

* * * * *